United States Patent [19]

McKenna

[11] Patent Number: 4,475,752

[45] Date of Patent: Oct. 9, 1984

[54] OVERHEAD PANEL LATCH

[75] Inventor: Patrick M. McKenna, Mukilteo, Wash.

[73] Assignee: The Boeing Company, Seattle, Wash.

[21] Appl. No.: 290,465

[22] Filed: Aug. 6, 1981

[51] Int. Cl.[3] ..... E05C 3/16

[52] U.S. Cl. ..... 292/210; 128/206.27; 244/118.5; 292/227; 292/DIG. 73

[58] Field of Search ..... 292/210, 336, 341.12, 292/DIG. 56, DIG. 73; 292/227, 228, 304, 341.17; 244/118.5; 128/206.27

[56] References Cited

U.S. PATENT DOCUMENTS

| | | | |
|---|---|---|---|
| 1,905,983 | 4/1933 | Harder | 292/210 X |
| 2,530,365 | 11/1950 | Johnson et al. | 292/341.12 X |
| 2,574,961 | 11/1951 | Couture | 292/210 X |

FOREIGN PATENT DOCUMENTS

| | | | |
|---|---|---|---|
| 593058 | 8/1925 | France | 292/336 |

*Primary Examiner*—Gary L. Smith
*Assistant Examiner*—R. Illich
*Attorney, Agent, or Firm*—James P. Hamley; Bernard A. Donahue; Laurence A. Savage

[57] ABSTRACT

A latch for securing a panel within an overhead opening includes a base portion which is secured to the panel. A cam is pivotally mounted to the base and is biased such that upon insertion of the panel into the opening a foot on the cam snaps over adjoining structure, pinching the structure against the base and thereby securing the panel. A trigger mechanism pivotally mounts to the cam and is configured to lock the cam in an unlatched position upon desired removal of the panel.

3 Claims, 5 Drawing Figures

PUSH UP TO UNLATCH
PUSH UP TO UNLATCH
PUSH TO RESET
82
84
44
46
102
80
12
14
106
48
100
38
58
42
86
89
90
88
92

OVERHEAD PANEL LATCH

BACKGROUND OF THE INVENTION

The present invention pertains to the mechanical latching art and, more particularly, to a latch for securing an overhead panel.

Numerous overhead panel type latches have been developed in the prior art. A common application for such latching devices is in the aircraft art wherein removable panels are secured in the overhead portion of the passenger compartment, thereby allowing ready access to aircraft control structure which is routed between the fuselage shell and the ceiling.

It is important in this application that the panels be held firmly in place and yet allow quick and easy removal and installation.

A typical latch mechanism used in this application is the spring-loaded rocker cam type latch. This latch is mounted on the removable panel and has a rocker cam which is biased by a spring such that a projection from the cam extends past the edge of the panel. When the panel is installed within the provided housing opening, the projecting rocker cam is depressed by the adjoining aircraft structure until the cam moves beyond the structure lip at which point, via the spring bias, the cam extension swings out past the adjoining structure lip to thereby support the panel. On panel removal, a pointed object is inserted through a provided hole in the ceiling where it engages the opposite end of the rocker cam causing the cam to rotate thereby moving the cam extension out of interference with the adjoining structure and releasing the panel.

A principal problem with the latches known to the prior art is that panel removal would oftentimes prove cumbersome. This is due to the fact that the rocker cam latches are constantly biased to the latched position, that is, the cam extensions are always biased in a direction assuring interference contact with adjoining structure. Thus, removal of a panel which has multiple latches requires that each and every latch be manually rotated and held in the released position until the panel is clear of adjoining structure, a process that proved to be tedious and time consuming.

A further problem with prior art overhead panel latches is that they transmitted vibration from adjoining structure to the overhead panel. As a result, overhead panels have been known to audibly vibrate during flight, creating passenger annoyance.

SUMMARY OF THE INVENTION

It is an object of this invention, therefore, to provide an improved panel latching mechanism which is capable of being locked in the panel release position to thereby eliminate the need for constant manual control of the latches upon panel release.

It is a further object of the invention to provide the above-described improved panel latch which provides vibration isolation between the panel and adjoining structure.

It is an additional object of the invention to provide the above-described improved panel latch which allows quick installation and removal of the panel without the use of special tools.

Briefly, according to the invention, latching apparatus is provided for securing a panel within a provided opening in housing structure. The latching apparatus includes a base portion which is adapted to be affixed to the panel. A cam has foot and arm portions and is pivotally mounted to the base portion such that the cam may be pivoted to a latched position wherein the foot extends from the base for engaging adjoining housing structure and securing the panel thereto. The cam is also pivotal to an unlatched position wherein the foot disengages from the housing structure to thereby release the panel. A bias means tends to bias the cam to the latched position. A trigger means locks the cam in the unlatched position and is actuable to release the cam from this locked position.

Preferably, the latch secures the panel to adjoining structure by pinching the adjoining structure between the cam foot and the base portion, with the base portion being provided with a compliant pad affixed thereto such that the panel is vibrationally isolated from the support housing when the panel is secured therein.

DETAILED DESCRIPTION OF THE PREFERRED EMBODIMENT OF THE INVENTION

Figure 1:
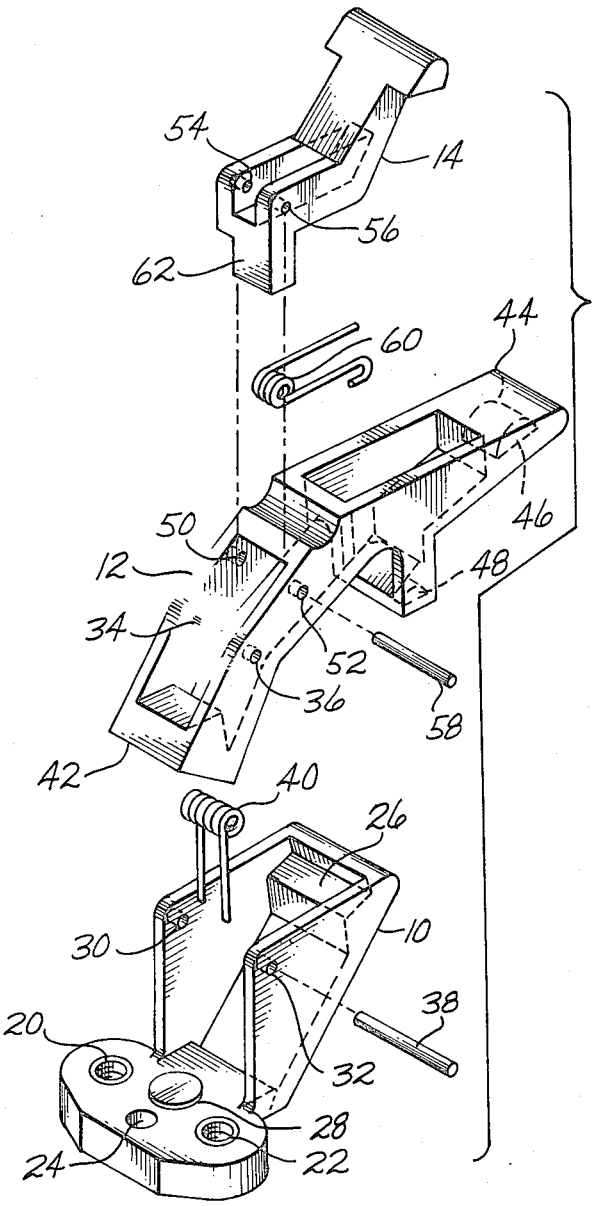
FIG. 1 is an exploded view of the construction of the preferred latch according to the invention.

FIG. 1 is an exploded, assembly drawing illustrating the preferred embodiment of the panel latch. The principal parts of the latch include a base portion 10, a cam 12 and a trigger mechanism 14.

The base 10 is adapted to mount to a panel via a pair of threaded bushings 20, 22 and a guide hole 24. As is shown more fully in FIG. 3, the guide hole 24 mounts over a guide pin provided on the panel thereby locating the base 10 and the adjoining housing structure. Mounting screws through the panel are secured within threaded bushings 20, 22.

The base portion 10 is provided with a stepped surface 26 which cooperates with the trigger 14 in a manner discussed more fully hereinbelow to provide a locked unlatched position for the latch. A compliant rubber pad 28 is secured by suitable means to the base portion 10. In a manner discussed more fully hereafter, the pad provides panel vibration isolation.

The cam 12 is pivotally mounted to the base portion via provided holes 30, 32 in the base, provided holes 34, 36 in the cam 12 and a pin 38. A spring 40 also mounts over the pin and is configured to apply a rotational force to the cam 12 with respect to the base 10 such that the cam is normally biased in the latched position, as will be understood more fully hereinbelow. A projection 62 from the trigger lever 14 engages the stepped surface 26 of the base portion 10 in the unlatched position.

Figure 2:
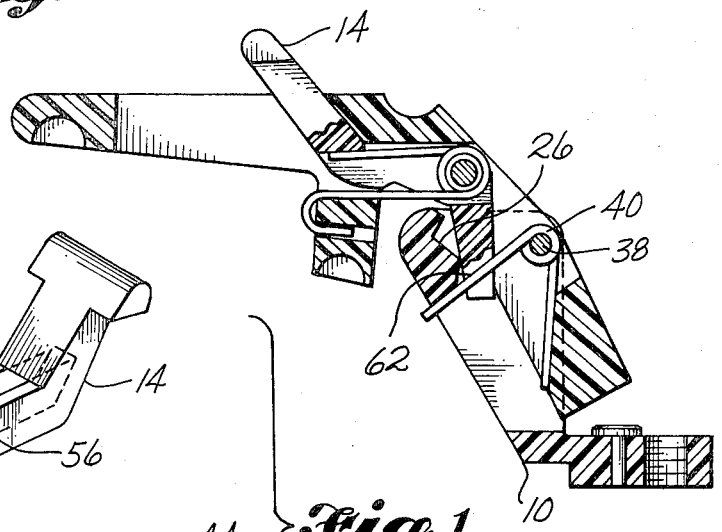
FIG. 2 is a cross-sectional, cut away view of the assembled latch shown in the latched position.

FIG. 2 is a cross-sectional, cut-away view of the assembled latch showing the latch in its latched position. Thus, shown is the base portion 10, cam 12 and trigger lever 14. The spring 40 which rides over pin 38 constantly tends to bias the cam 12 in the latched position, as shown. The extension 62 from the trigger lever 14 does not engage the stepped surface 26 of the base portion in this the latched position.

Figure 3:
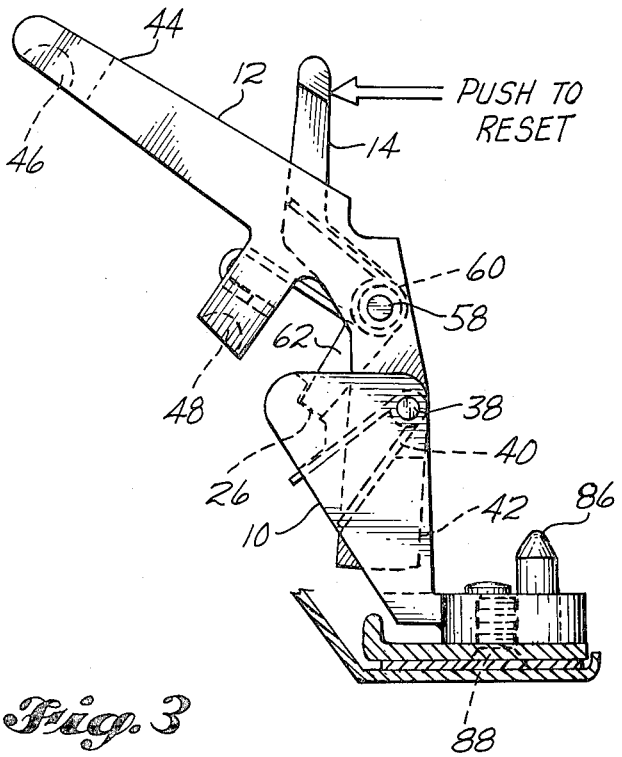
FIG. 3 is a cross-sectional, cut away view of the latch shown in the reset, or unlatched position.

FIG. 3 is a cross-sectional, cut-away view of the panel latch shown in the unlatched position. Here, a rotational force applied to the cam arm 44, as caused by a pointed object received within recesses 46, 48 causes the cam 12 to pivot about pin 38 to the point that the extension 62 on trigger lever 14 engages and is supported by the stepped surface 26. The spring 60 tends to bias the trigger lever 14 into this position.

Figures 4, 5:
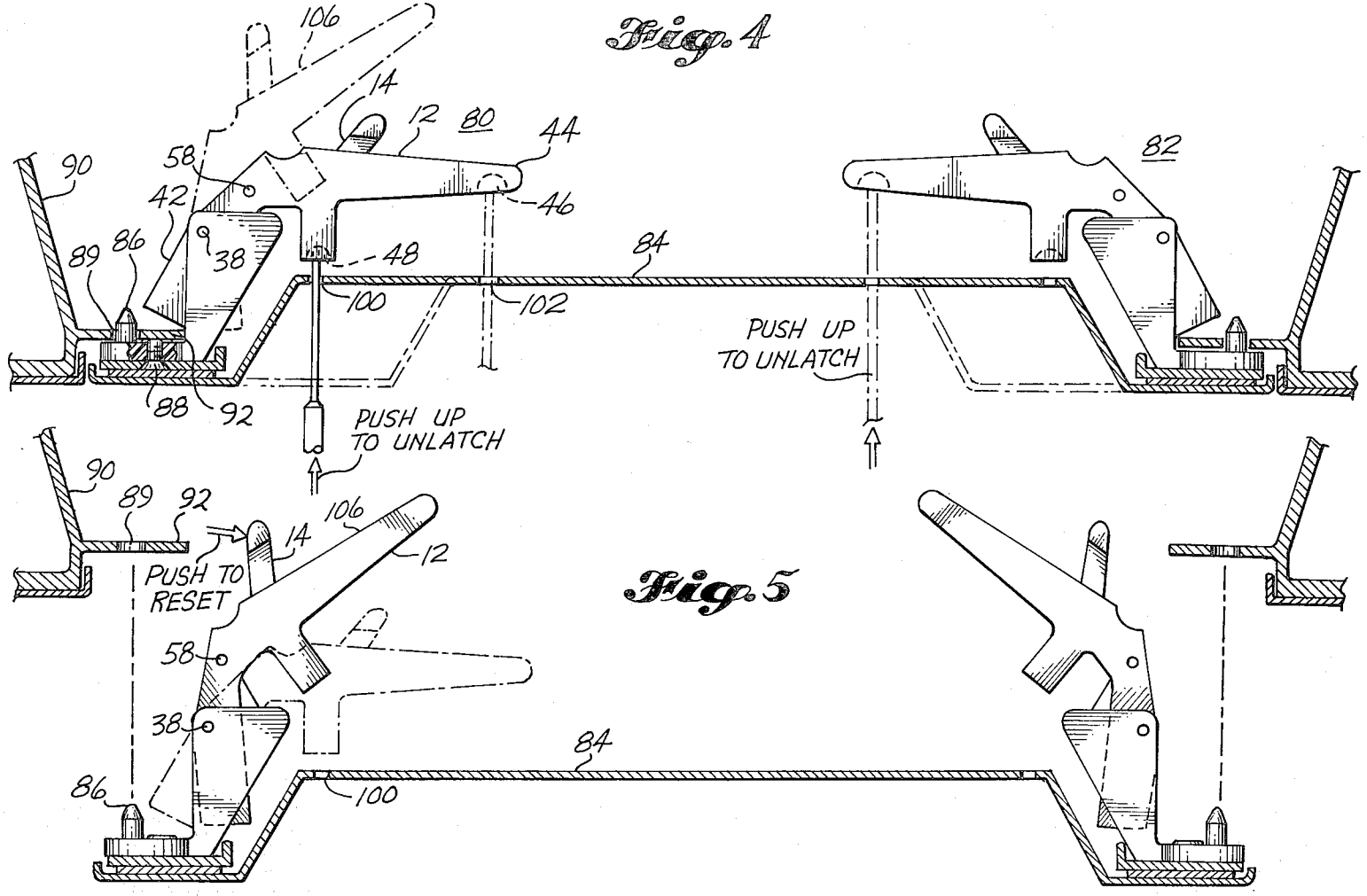
FIG. 4 illustrates a pair of the latches secured to a panel, with the panel secured within housing structure.
FIG. 5 illustrates removal of the panel of FIG. 4 from the housing structure by locking release action of the latches.

In this, the locked, unlatched position, the cam foot 42 is locked in a position such that its corresponding panel is releasable from support structure, as is more clearly understood with respect to FIGS. 4 and 5. The latch may be easily released from the locked, unlatched position by application of a force, indicated as "PUSH TO RESET" on the end of trigger lever 14 to remove the extension 62 of trigger lever 14 from the stepped surface 26, thereby allowing spring 40 to rebias the cam 12 in the latched position.

FIG. 4 illustrates a pair of latches, indicated generally at 80, 82 which are mounted to an overhead panel 84. As previously described, the latches, such as latch 80, are predeterminedly located on the panel via a guide pin, such as pin 86, which is received through the guide hole (such as guide hole 24 of FIG. 1) provided in the latch base portion and through a hole 89 in adjoining housing structure. Screws, such as screw 88, secure the panel to the latch via bushings (such as bushing 22 of FIG. 1).

As shown in FIG. 4, the panel bearing the latches 80, 82 is secured within the provided opening in the housing, indicated generally at 90 by pushing the panel up and into the housing opening. Upon insertion of the panel, it will be understood that a lip, such as lip 92, forcibly engages the edge of the cam foot 42 tending to rotate the cam 12 to allow passage thereof past said lip 92. The latch is designed, however, such that there is insufficient cam rotation upon panel insertion to cause the latch to activate to its locked, unlatched position. Sufficient panel insertion causes the foot portion 42 via its bias spring (spring 40 of FIG. 1) to snap over the lip portion 92 thereby pinching the lip 92 between the foot 42 and the rubber pad 28 on the base portion. Now, the latch assumes its latched position and secures the panel to the support structure 90. The pad 28 isolates the panel 84 from vibration which appears on the support structure 90, thereby minimizing or eliminating audible panel vibration.

To remove the panel 84 from its mounting in the support structure, a panel hole may be provided either as shown at position 100 or position 102 through which a suitable tool may be inserted to engage either of the recesses 48, 46 respectively. Further insertion of the tool causes the cam 12 to rotate to its unlatched position, as shown dotted at 106.

As is shown in FIG. 5, the cam 12 rotates to the point that the trigger lever 14 locks the cam 12 in the unlatched position such that the cam foot 42 no longer engages the support structure 90. The panel is, thus, free to drop away from its provided opening in the housing structure. Because each latch 80, 82 locks into the unlatched position, removal of a panel bearing such improved latches is a very swift, efficient process. Prior to reinsertion of the panel, each latch may be easily reset from the locked position by pushing the end of the trigger lever. Thus, removal and insertion of the panel is accomplished in a positive, efficient manner.

In summary, an improved panel latch has been disclosed. The latch features a locking mechanism which is easily actuable to maintain the latch in its unlatched position. Further, the improved latch provides vibration isolation to its companion panel from surrounding support structure. In addition, the latch may be actuated without the use of special tools.

While a preferred embodiment of the invention has been described in detail, it should be apparent that many modifications and variations thereto are possible, all of which fall within the true spirit and scope of the invention.

I claim:

1. Latching apparatus for securing a panel within a provided opening in housing structure, comprising:

a base portion adapted to be affixed to said panel and having a stepped surface provided thereon;

a cam having a foot portion and an arm portion, said cam being pivotally mounted to said base portion such that the cam is pivotal to a latched position wherein said foot extends from said base for engaging said housing structure and securing said panel thereto, said cam also being pivotal to an unlatched position wherein said foot disengages from said housing structure to release said panel therefrom;

a trigger lever pivotally mounted to said cam, said trigger lever being pivotal such that one end thereof engages said stepped surface thereby causing the remaining end of such lever to engage said cam and bias the same to said unlatched position, said trigger lever further being actuable to release from support by said stepped surface such that said cam is free to pivot to said latched position; and bias means tending to bias said trigger lever to said engaging position with the stepped surface.

2. The latching apparatus according to claim 1 wherein said cam is configured such that in the latched position a portion of the housing structure is pinched between said cam foot and said base portion, thereby securing said panel.

3. The latching apparatus of either of claims 1 or 2 wherein said base portion further comprises a compliant pad affixed thereto, said pad being predeterminedly positioned to vibrationally isolate the panel from the support housing when the panel is secured to said housing.

* * * * *